US005579563A

United States Patent [19]

Sim

[11] Patent Number: 5,579,563

[45] Date of Patent: Dec. 3, 1996

[54] ADJUSTABLE BELT FASTENER WITH SPRING BIASED MALE FASTENER MEMBER

[76] Inventor: Jae K. Sim, 34 Jacalyn Dr., Havertown, Pa. 19083

[21] Appl. No.: 506,874

[22] Filed: Jul. 25, 1995

[51] Int. Cl.[6] ..... A44B 11/25

[52] U.S. Cl. ..... 24/585; 24/615; 24/616; 24/170

[58] Field of Search ..... 24/585, 615, 616, 24/170

[56] References Cited

U.S. PATENT DOCUMENTS

| | | | |
|---|---|---|---|
| 1,020,925 | 3/1912 | Nutter | 24/585 |
| 1,072,498 | 9/1913 | Redmond | 24/585 |
| 1,213,109 | 1/1917 | Kilstrom | 24/585 |
| 1,483,853 | 2/1924 | Schwerd | 24/585 X |
| 1,887,825 | 11/1932 | Statham | 24/585 X |
| 3,466,668 | 9/1969 | Ochiai | 24/585 X |
| 4,669,155 | 6/1987 | Chen | 24/170 |
| 4,733,440 | 3/1988 | Ogawa | 24/585 X |

*Primary Examiner*—Peter M. Cuomo
*Assistant Examiner*—Stephen Vu
*Attorney, Agent, or Firm*—Birch, Stewart, Kolasch & Birch, LLP

[57] ABSTRACT

An adjustable belt fastener comprising a male fastener member adapted to be attached to one end portion of a belt, the male fastener member including a spring biased operating plate provided with a tongue member, and a female fastener member adapted to be attached to the other end portion of the belt, the female fastener member including a plurality of slots for selectively receiving the tongue member of the operating plate.

9 Claims, 1 Drawing Sheet

FIG. 1
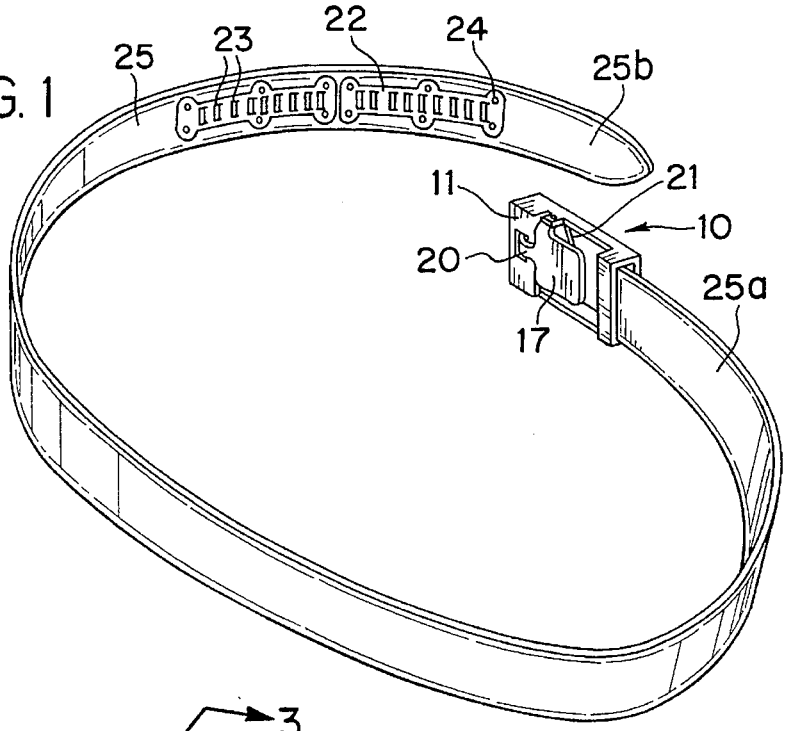
FIG. 2
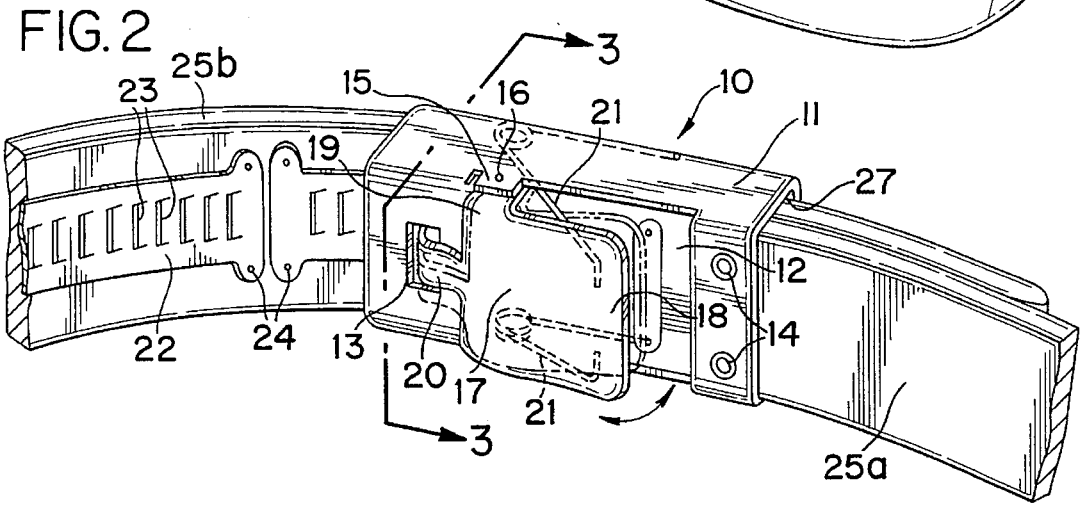
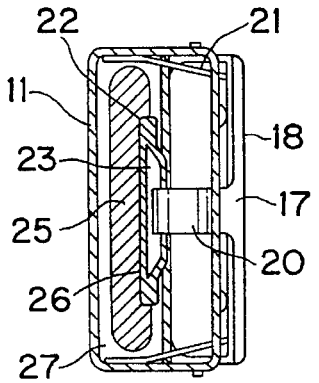
FIG. 3
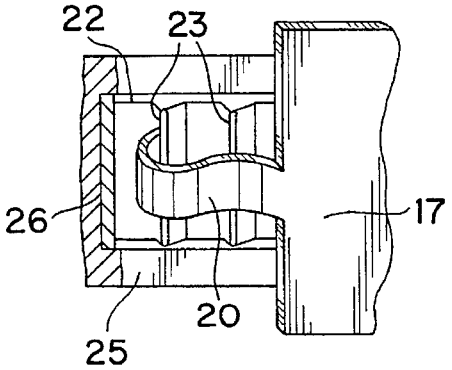
FIG. 4

ADJUSTABLE BELT FASTENER WITH SPRING BIASED MALE FASTENER MEMBER

BACKGROUND OF THE INVENTION

1. Field of the Invention

The present invention relates to an adjustable belt fastener and more particularly, to an improved adjustable belt fastener including female and male fastener members attached to opposite ends of a belt, the female fastener member containing a series of slots and the male fastener member having a spring biased tongue for selectively engaging in one of the slots depending upon the desired length of the belt.

2. Description of Related Art

Various types of adjustable belt fasteners are known in the art. Such conventional adjustable belt fasteners suffer from a number of problems such as, for example, they are difficult to lock in and unlock from both ends of the belt because the locking pin is not firmly engaged since the pin can readily break away from the bore. Furthermore, such conventional fasteners are complicated in structure, expensive to manufacture, difficult to use, and readily break away from the belt.

SUMMARY OF THE INVENTION

Accordingly, it is an object of the present invention to provide an adjustable belt fastener, which eliminates the above problems encountered with conventional adjustable belt fasteners.

Another object of the present invention is to provide an adjustable belt fastener which includes a male fastener member having a spring biased tongue for engaging with one of a series of or slots of a female fastener, the male and female fastener members being attached to both ends of the belt.

A still further object of the present invention is to provide an adjustable belt fastener which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to an adjustable belt fastener which includes a male fastener member attached to one end and a female fastener member attached to the other end of the belt, the female fastener member having a series of slots and the male fastener member having a spring biased tongue which can be inserted into or released from the slot for locking, unlocking, and changing the length of the belt.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is a perspective view of an adjustable belt fastener attached to a leather belt in an unlocking position according to the present invention;

FIG. 2 is an enlarged perspective view of the adjustable belt fastener attached to a leather belt in a locked position according to the present invention;

FIG. 3 is a cross-sectional view of FIG. 2 taken along line 3—3; and FIG. 4 is an enlarged perspective view of the adjustable belt fastener in a locking position according to the present invention.

DETAILED DESCRIPTION OF THE PREFERRED EMBODIMENTS

Referring now in detail to the drawings for the purpose of illustrating preferred embodiments of the present invention, the adjustable belt fastener 10 as shown in FIGS. 1, 2, and 3, comprises a male fastener member 11 having a tongue 20 attached to a first end portion 25*a* of belt 25, and a female fastener member 22 having a plurality of slots 23 attached to a second end portion 25*b* of the belt 25, which can be made of leather.

The fastener member 11 includes a large opening 12 and a small opening 13 disposed on an inner surface thereof, a pair of supports 15 extending from both front sides of the large opening 12, an operating plate body 17 having a pair of legs 19 for pivotally engaging with the pair of supports 15 through pivotal pins 16, and a pair of springs 21 for biasing the operating plate 17 containing tongue 20 into selective engagement with one of said slots 23.

The operating plate body 17 which includes the tongue 20 has a handle disposed at a front end portion and a rear end portion thereof. Therefore, the tongue 20 and the operating plate body 17 mate with the small opening 13 and the large opening 12, respectively. The fastener member 11 can be firmly attached to the first end 25*a* of the belt 25 by first fixing members 14. The spring 21 has a V-shaped configuration (FIG. 2).

As shown in FIGS. 2 and 3, each female fastener member 22 is provided with recess 26 of the second end portion 25*b* of the belt 25 which includes a series of slots 23 which are equally spaced along the female fastener member 2. Each female fastener member 22 is attached to the recess 26 through second fixing member 24. The first and second fixing members 14 and 24 are punched into the belt. The female fastener member 22 has 1 to 3 members, preferably 2 members for controlling the flexibility of the second portion 25*b* of the belt 25.

As shown in FIGS. 2, 3, and 4, the adjustable belt fastener 10 according to the present invention operates as follows. The two belt end portions 25*a* and 25*b* are locked together by the elongated female fastener members 22 and the male fastener member 11. At this time, after the user pushes the handle 18 of the operating plate body 17 with a finger, if the pushed finger is released from the handle 18, the tongue 20, as like a hook, firmly and automatically locks in one of the slots 23 of the female fastener member 22 (FIGS. 3 and 4).

Alternatively, when the locked belt 25 is unlocked by disengaging the end portions 25*a* and 25*b* from each other, the handle 18 is pushed by the finger. Also, when the user wants to change the length of the locked belt 25, the handle 18 is pushed and stopped by the finger so as to adjust the length of the belt 25.

Since the male fastener member 11 has the hollow space 27, the second end portion 25*b* having the female fastener member 22 can be smoothly inserted into and engaged with the hollow space 27 thereof. Also, a plurality of the separated female fastener members 22 are attached on the recess 26 of the second end portion **25*b* of the belt 25, so that the second end portion 25*b* is very flexible even if the female fastener member 22** is attached thereto.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An adjustable belt fastener comprising:

a belt having first and second end portions, a male fastener member adapted to be attached to one end portion of the belt, said male fastener member including a spring biased operating plate provided with a tongue member, the plate being pivotally mounted to a pair of supports provided on the male fastener member, the pair of supports being mounted on opposite sidewalls of the male fastener member, first and second openings being provided in the male fastener member, the tongue member being movable through the first opening and the plate being pivotable toward and away from the second opening, a width of the tongue member being less than a width of the plate and the male fastener member having rear portions extending between the sidewalls and defining opposing edges of the second opening; and a female fastener member adapted to be attached to the second end portion of the belt, said female fastener member including a plurality of slots for selectively receiving the tongue member of the operating plate, the second end portion of the belt having two edges and the slots being generally perpendicular to the edges of the second end portion of the belt, the second end portion of the belt further having a width which is greater than a length of each of the plurality of slots such that the slots are spaced from the edges of the second end portion of the belt, the tongue member being movable through the first opening into engagement with and disengagement from the female fastener member upon pivoting of the plate on the supports, the tongue member engaging one of the plurality of slots in the female fastener member when the plate moves away from the second end portion of the belt and the tongue member disengaging from the slot to release the belt when the plate moves toward the second end portion of the belt, wherein the female fastener member is mounted to the second end portion of the belt by fixing members.

2. The adjustable belt fastener of claim 1, wherein the female fastener member has one to three sections.

3. The adjustable belt fastener of claim 2, wherein the female fastener member has two sections.

4. The adjustable belt fastener of claim 1, further comprising at least one spring for biasing the plate away from the second opening and the first end portion of the belt, at least one said spring having a v-shaped configuration.

5. The adjustable belt fastener of claim 4, wherein the first opening is smaller than the second opening and wherein the tongue member and plate are of a one-piece construction.

6. The adjustable belt fastener of claim 5, wherein the first end portion of the belt is firmly attached to the male fastener member by fixing members on the male fastener member, the first end portion of the belt being received in the male fastener member between the sidewalls and beneath at least one of the rear portions of the male fastener member, the fixing members on the male fastener member passing through at least one said rear portion when affixing the first end portion of the belt to the male fastener member.

7. An adjustable belt fastener comprising:

a belt having first and second end portions, a male fastener member mounted to first end portion of the belt by first fixing members, said male fastener member including a spring biased operating plate provided with a tongue member, the plate being pivotally mounted to a pair of supports provided on the male fastener member, the pair of supports being mounted on opposite sidewalls of the male fastener member, first and second openings being provided in the male fastener member, the first opening being smaller than the second opening, the tongue member being movable through the first opening and the plate being pivotable toward and away from the second opening, a width of the tongue member being less than a width of the plate and the male fastener member having rear portions extending between the sidewalls and defining opposing edges of the second opening;

a female fastener member mounted to the second end portion of the belt by second fixing members, the female fastener have a plurality of sections and each of the sections including a plurality of slots for selectively receiving the tongue member of the operating plate, the second end portion of the belt two edges and the slots being generally perpendicular to the edges of the other end portion of the belt, the second end portion of the belt further having a width which is greater than a length of each of the plurality of slots such that the slots are spaced from the edges of the other end portion of the belt, the tongue member being movable through the first opening into engagement with and disengagement with the female fastener member upon pivoting of the plate on the supports, the tongue member engaging one of the plurality of slots in the female fastener member when the plate moves away from the second end portion of the belt and the tongue member disengaging from the slot to release the belt when the plate moves toward the second end portion of the belt; and at least one spring for biasing the plate away from the second opening and the first end portion of the belt, at least one said spring having a v-shaped configuration, the first end portion of the belt being received in the male fastener member between the sidewalls and beneath at least one of the rear portions of the male fastener member, the first fixing members on the male fastener member passing through the at least one rear portion when affixing the first end portion of the belt to the male fastener member.

8. The adjustable belt fastener of claim 7, wherein the female fastener member has one to three sections.

9. The adjustable belt fastener of claim 8, wherein the female fastener member has two sections.

* * * * *